US005294967A

United States Patent [19]

Munakata et al.

[11] Patent Number: 5,294,967

[45] Date of Patent: Mar. 15, 1994

[54] IMAGE FORMING APPARATUS WITH A PLURITY OF ADJUSTABLE DEVELOPING UNITS

[75] Inventors: Atsushi Munakata; Masahiro Itoh; Akira Watanabe; Yuji Sakemi, all of Yokohama, Japan

[73] Assignee: Canon Kabushiki Kaisha, Tokyo, Japan

[21] Appl. No.: 485,476

[22] Filed: Feb. 27, 1990

[30] Foreign Application Priority Data

Feb. 28, 1989 [JP] Japan ..... 1-047585
May 31, 1989 [JP] Japan ..... 1-138782

[51] Int. Cl.[5] ..... G03G 15/01
[52] U.S. Cl. ..... 355/326 R; 355/245
[58] Field of Search ..... 118/656, 657, 658; 355/214, 246, 251, 259, 261, 268

[56] References Cited

U.S. PATENT DOCUMENTS 3,987,756 10/1976 Katayama et al. ..... 118/637
4,777,107 10/1988 Kurematsu et al. ..... 118/658 X
4,841,329 6/1989 Kasamura et al. ..... 355/326 X
4,865,936 9/1989 Asanae et al. ..... 355/251 X
4,873,551 10/1989 Tajima et al. ..... 355/253 X
4,891,674 1/1990 Seyfried ..... 355/251 X
4,922,301 5/1990 Katoh et al. ..... 355/326 X
4,928,146 5/1990 Yamada ..... 355/253
4,933,254 6/1990 Hosoi et al. ..... 355/251 X
4,939,548 7/1990 Yamada et al. ..... 355/245
4,941,018 7/1990 Kasamura et al. ..... 355/245

*Primary Examiner*—Leo P. Picard
*Assistant Examiner*—Christopher Horgan
*Attorney, Agent, or Firm*—Fitzpatrick, Cella, Harper & Scinto

[57] ABSTRACT

A developing apparatus having a supporting frame for supporting plural developing units. The supporting frame is movable to present a selected one of the developing units to a development operating position. The supporting frame is provided with positioning members for positioning the developing units. The positioning members are fixed on the movable frame in the manner that the position of the positioning member is adjustable. Each of the developing units is faced to an image bearing member at the operating position without contact to the image bearing member.

12 Claims, 12 Drawing Sheets

IMAGE FORMING APPARATUS WITH A PLURITY OF ADJUSTABLE DEVELOPING UNITS

FIELD OF THE INVENTION AND RELATED ART

The present invention relates to an image forming apparatus such as an electrophotographic or electrostatic recording apparatus equipped with a developing device for developing an electrostatic latent image, more particularly to an image forming apparatus for forming a multi-color images.

Some electrophotographic or electrostatic recording apparatus are provided with a developing device of an magnetic brush type, including a frame 300 rotatable about a shaft 301 as shown in FIG. 1, to develop a latent image formed on an image bearing member through predetermined process steps.

In such a developing device, in order to assure a distance d between a developing roller 102 for carrying the developer and a photosensitive drum 1 in the form of a cylinder, spacer rollers 109 are supported coaxially with the developing roller 102 and are abutted to the photosensitive drum 1 or disks supported coaxially with the drum 1.

The spacer rollers 109 have a radius equal to the radius R of the developing roller 102 plus the distance d to exist between the developing roller 102 and the photosensitive drum 1.

Such a structure is used (1) because the distance d between the developing roller 102 and the photosensitive drum 1 is significantly influential to the density and the quality of the image formed and (2) because the distance is usually very small. Recent demand to the image forming apparatus such as a printer or a copying machine includes the color graphic output or the like which require higher quality of images. In order to accomplish it, that is, in order to develop the latent image on the photosensitive drum 1 more faithfully, the distance d between the photosensitive drum 1 and the developing roller 102 is further reduced, more particularly, to not more than 1 mm.

In the image forming apparatus of the above described type, it is unavoidable that some developer is released and scattered from the surface of the developing roller 102 and that some developer is released and scattered from the surface of the photosensitive drum 1. If the released and scattered developer reaches the contact surfaces between the spacer roller 109 and the photosensitive drum 1, the developer is compressed by the contact surfaces, with the result that the developer is fused on the surface of the spacer roller 102 or the surface of the photosensitive drum 1. Then, small projections are formed on the surfaces.

The projections thus formed impede smooth rotation of the photosensitive drum 1 and the roller 109 which are contacted during the rotation. As a result, during the rotation, the distance d between the developing roller 102 and the photosensitive drum 1 changes, or the photosensitive drum 1 is vibrated, or the vibration is transmitted to the optical system, and therefore, the latent or developed image is disturbed to obstruct the high quality image formation. Particularly in the case of a multi-color image forming apparatus wherein plural color images are overlaid, the disturbances in the respective color images are combined to deteriorate the image quality.

When the developer is fused on the surface of the spacer roller 109 and/or the surface of the photosensitive drum 1, the distance d, which is significantly influential to the image formation, increases, and therefore, the strength of the developing electric field existing in the distance d decreases, so that the density of the developed image is decreased as a whole.

In an image forming apparatus wherein plural developing units are used to be sequentially presented for the developing operation to form a multi-color image, as disclosed in U.S. Pat. No. 4,622,916, abutment action can not be avoided between the spacer roller 109 of the developing unit coming to the developing position and the photosensitive drum 1. If the abutment occurs between the spacer roller 109 and the photosensitive drum 1 while the latent image forming operation is being carried out, the quality of the image is locally deteriorated due to the vibration of the optical system or the vibration of the image bearing member caused by the abutment action. The deterioration of the images of the different colors are influential to each other with the result that the quality of the total color image is remarkably deteriorated.

SUMMARY OF THE INVENTION

Accordingly, it is a principal object of the present invention to provide a multi- or full-color image forming apparatus wherein the gap between a developer carrying member of each of developing units and the image bearing member is precisely maintained constant for a long period of time, thus providing high quality images for the long period of time.

In this embodiment, each of the developing units is mounted on a movable supporting means. The movable supporting means has a movable base and a plurality of positioning members which are mounted for position adjustment on the movable base. Each of the developing units is engaged with the associated one of the positioning members, so that each of the developing units is correctly positioned to provide a predetermined clearance between the image bearing member and the developer carrying member of each of the developing units. Therefore, the developing units do not have the spacer member for abutment with the image bearing member. This provides a solution to the problems arising from the abutment action described above.

Usually, there is a slight eccentricity in the image bearing member or in the developer carrying member. When the spacer is used as in the abovedescribed prior art, the eccentricity is automatically compensated due to the mechanical structure. However, in the present invention without the spacer, the eccentricity can result in the change, with the rotations thereof, between the image bearing member and the developer carrying member.

It is a further object of the present invention to provide a multi- or full-color image forming apparatus which can provide a multi- or full-color image of high quality even if the gap between the image bearing member and the developer carrying member varies due to the eccentricity thereof or the like.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
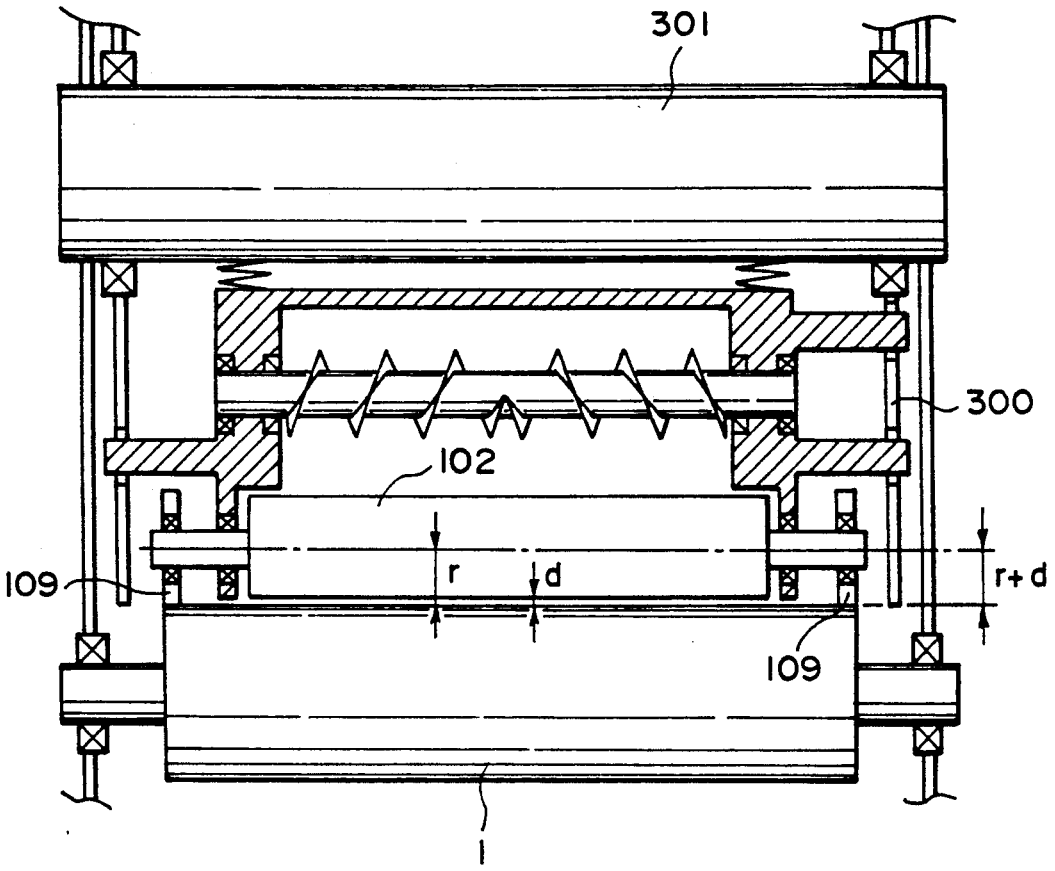
FIG. 1 is a sectional view of a conventional image forming apparatus.
Figure 2:
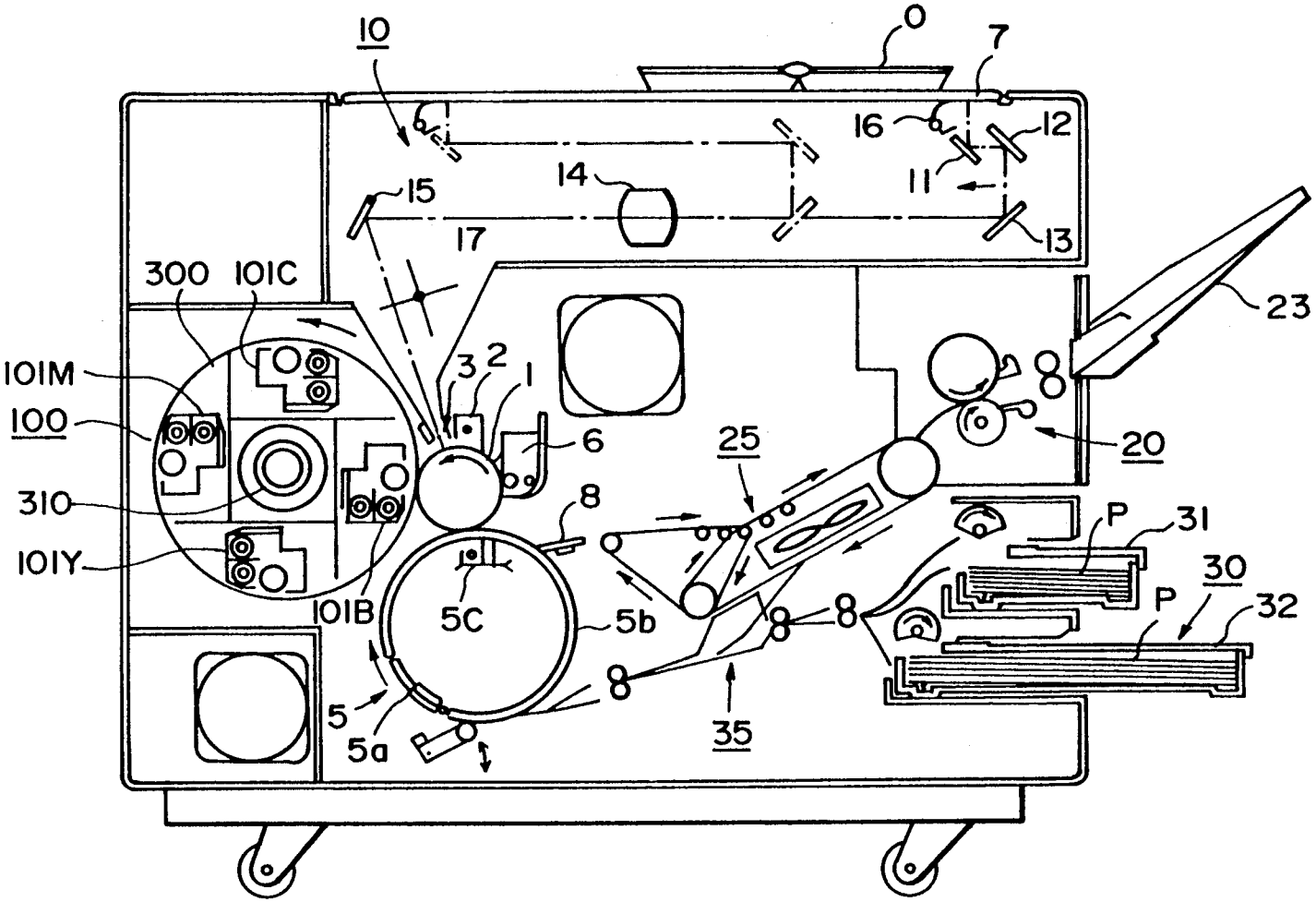
FIG. 2 is a sectional view of an image forming apparatus to which the present invention is applicable.

Referring to FIG. 2, there is shown a general arrangement of a full-color electrophotographic copying machine according to an embodiment of the present invention. The copying machine has a cylindrical photosensitive drum 1 having a surface electrophotographic photosensitive layer disposed substantially at the center of the copying machine and is rotatable in a direction indicated by an arrow (counterclockwise direction).

Substantially right above the photosensitive drum 1, there is disposed a primary charger 2; at the left side of the photosensitive drum 1, there is a rotary type developing device 100; at the position substantially right below the photosensitive drum 1, there is an image transfer device 5; and at the right side of the photosensitive drum 1, a cleaning device 6 is disposed.

At the top of the electrophotographic copying machine, there is a known optical system 10 which functions to project an image of an original O placed on a transparent platen 7 made of glass or the like onto the photosensitive drum 1 at an image exposure station 3 which is between the primary charger 2 and the rotary type developing device 100, through a slit. The optical system 10 is of any known type. In this embodiment, it comprises a first scanning mirror 11, second and third mirrors 12 and 13 movable in the same direction as the first scanning mirror 11 and at a speed one half of the speed of the first scanning mirror 11, an imaging lens 14 and a fourth mirror 15 fixed.

The original illuminating source 16 moves together with the first scanning mirror 11, and the color separation filter 17 including red, green, blue and ND filters is disposed between the fourth fixed mirror 15 and the exposure station 3.

The light image formed by the reflected light from the original 0 scanned by the first, second and third scanning mirrors 11, 12 and 13 passes through the lens 14, and is reflected by the fourth fixed mirror 15, and is color-separated by the filter 17, and is finally imaged at the exposure station 3 on the photosensitive drum 1 having been charged by the charger 2. By this, an electrostatic latent image corresponding to the selected color is formed.

For each of the colors of the color separation filter 17, the photosensitive drum 1 is subjected to the charging, exposure, developing, image transfer and cleaning operations by the primary charger 2, the optical system 10, the rotary developing device 100, the image transfer device 5 and the cleaning device 6.

The rotary developing device 100 includes a supporting frame 300 rotatable about a shaft 310 in the direction indicated by an arrow and developing units detachably mounted on the supporting frame 300 at the intervals of 90 degrees (in this embodiment, four developing units are mounted, more particularly, a yellow developing unit 101Y containing yellow toner, a magenta developing unit 101M containing a magenta toner, a cyan developing unit 101C containing cyan developer and a black developing unit 101B containing black developer).

The latent image corresponding to each of the colors formed on the photosensitive drum 1 is visualized by the developer of the developing unit. More particularly, by controlling the angular position of the rotatable frame 300, a selected one of the developing units is presented to the photosensitive drum 1, by which the developing roller of the unit is faced to the photosensitive drum 1 at the operating position, so that the developing operation is performed with the developing unit. During the developing operation, the developing roller is supplied with an AC voltage, a DC biased AC voltage in the form of a sine wave or rectangular wave (vibrating voltage) as the developing bias voltage, by which the toner is repeatedly deposited onto and released from the photosensitive drum, and finally the latent image is developed. FIG. 2 shows the situation wherein the black developing unit 101B is at the operating position where it is faced to the photosensitive drum 1.

The visualized image provided by the developing operation is transferred by the image transfer device 5 onto a transfer material P supplied from the sheet feeding device 30. The transfer device 5 is typically provided with a transfer drum 5*b* having a gripper 5*a* for gripping and retaining the transfer material P on its periphery. The transfer device 5 grips by the gripper 5*a* the leading edge of the transfer material P supplied from the transfer material cassette 31 or 32 of the sheet feeding device 30 through the transfer material conveying system 35. It carries the transfer material to receive the visualized images in the respective colors on the photosensitive drum 1. In the position where the image transfer occurs, a transfer charger 5*c* is disposed in the transfer drum 5.

The transfer material P having received the toner images superposedly is released from the gripper 5*a*, and is separated from the transfer drum 5*b* by a separation pawl 8. The transfer material P separated from the transfer drum 5*b* is conveyed by the transfer material conveying system 25 to an image fixing device 20, wherein the multi- or full-color toner image on the transfer material P is fixed. Subsequently, it is discharged onto the tray 23.

In this embodiment, a positive optical image of an original is projected directly on the photosensitive drum 1 through the lens 14. In this case, the developing action is a so-called regular development wherein dark potential portions of the latent image, that is, the portions not exposed to light, are deposited with the toner. To accomplish this, the toner particles in the developer supplied by the developing roller in each of the developing units are triboelectrically charged to the polarity which is the same as the polarity of the dark portion potential of the latent image, by the friction with the carrier particles.

However, the present invention is applicable to such an image forming apparatus in which the photosensitive drum is scanningly exposed to a light beam modulated in accordance with electric image signals, by which a latent image is formed. Such a type of image forming apparatus is capable of forming multi- or full-color images of high quality, and therefore, the present invention is particularly suitable. In this case, the light is projected to such regions of the photosensitive drum which are to receive the toner particles. Therefore, the developing system is of a reverse development type wherein the light potential regions are deposited with the toner. An example of such an image forming apparatus is shown in FIG. 3.

Figure 3:
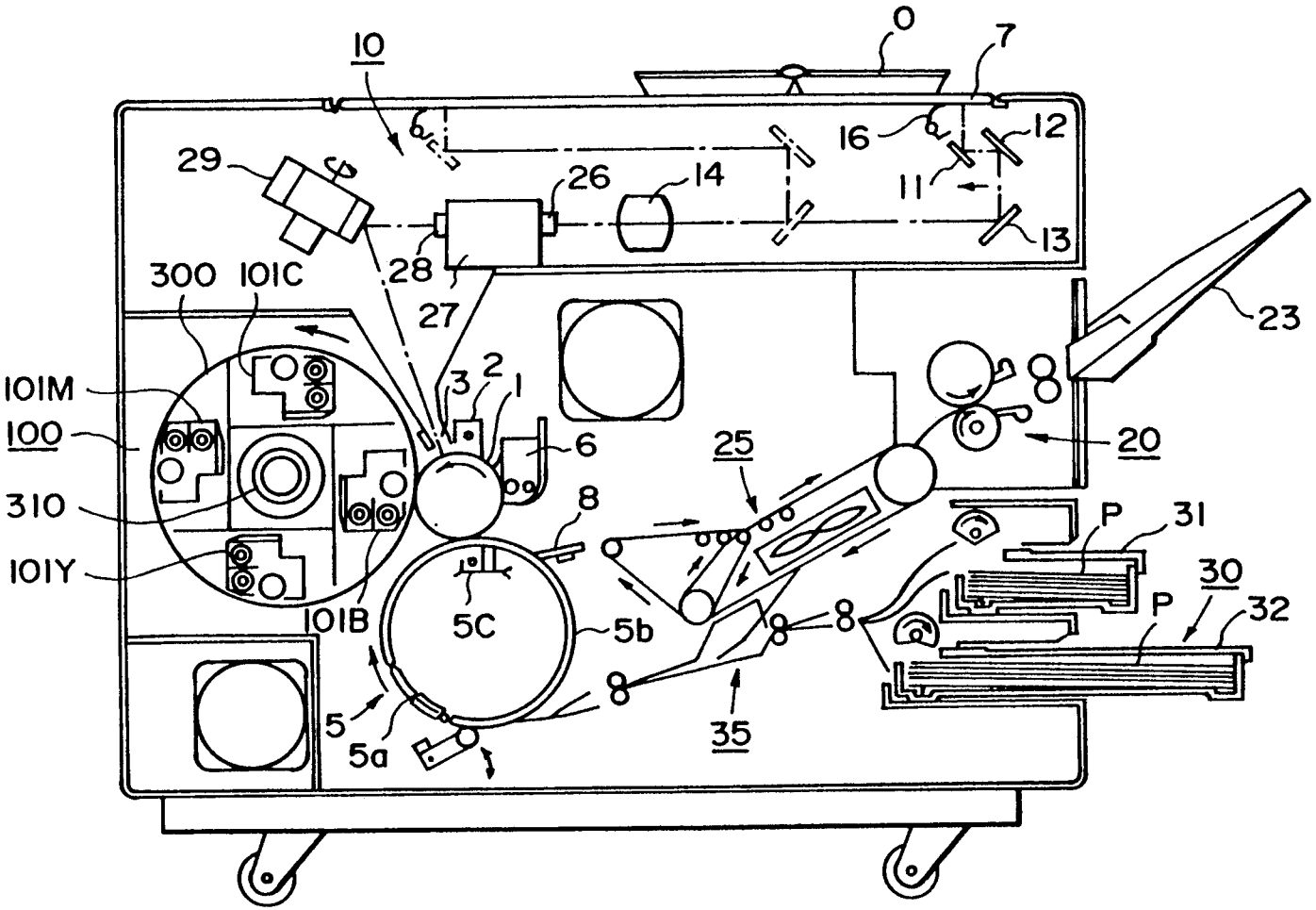
FIG. 3 is a sectional view of another example of an image forming apparatus to which the present invention is applicable.

Referring to FIG. 3, image light of the original O is imaged by the lens 14 on a photoelectric transducer element 26. The element 26 constitutes a color image reading element provided at the light receiving surface with color separation filter layer, i.e., red, green and blue filter layers. It produces electric signals corresponding to red, green and blue portions of the light image. The signals are processed by a signal processing circuit 27, and are converted to laser driving signals. The laser 28 is driven and modulated in accordance with the driving signals to produce an information laser beam corresponding to the selected color part of the image. The beam is deflected by a polygonal mirror 29 to raster-scan the drum 1.

The toner particles in the developer, which is conveyed to the developing position by the developer carrying member of each of the developing unit, are triboelectrically charged by the friction with the carrier particles to the same polarity as that of the dark portion potential of the latent image, and the toner particles are deposited to the light potential regions of the latent image to visualize it. In the other respects, the structures of the developing device is similar to FIG. 2 device. However, in FIG. 3, the laser 28 may be driven by an image signal from a computer or the like.

Figure 4:
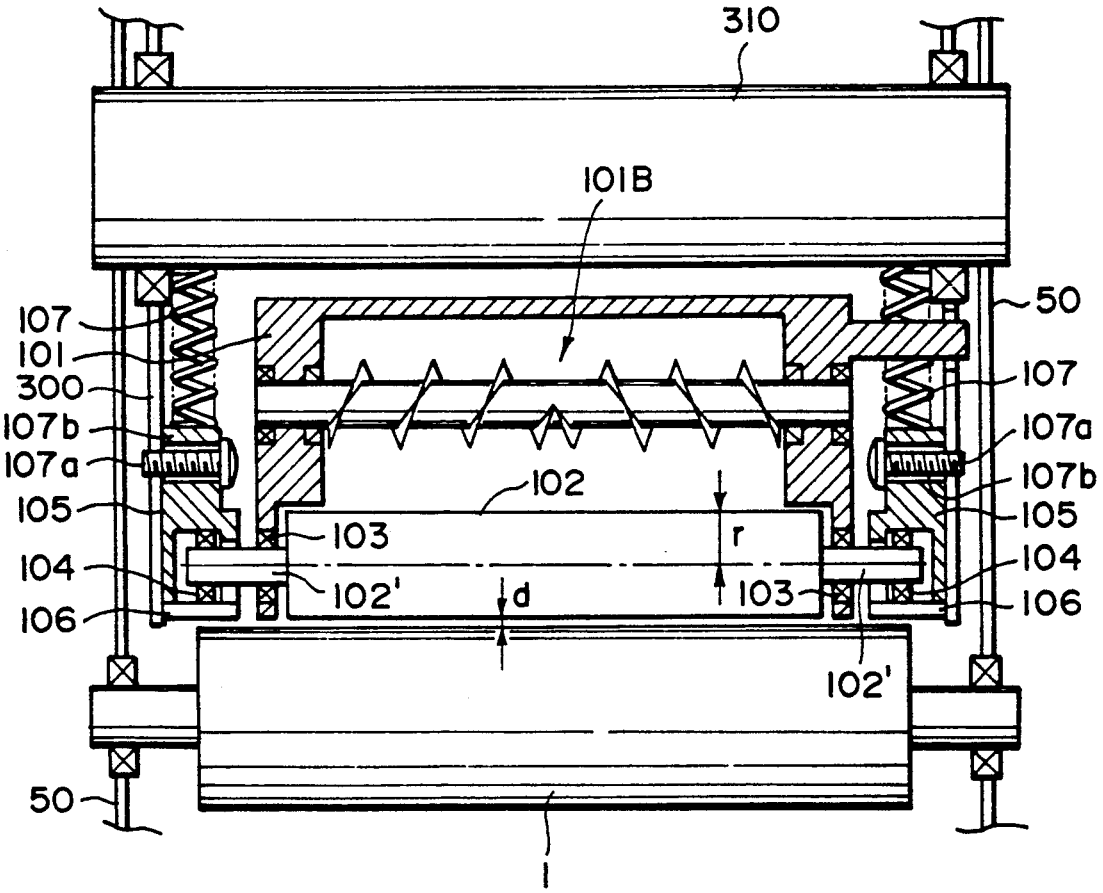
FIG. 4 is a front view of a major part of a developing apparatus according to an embodiment of the present invention.
Figure 5:
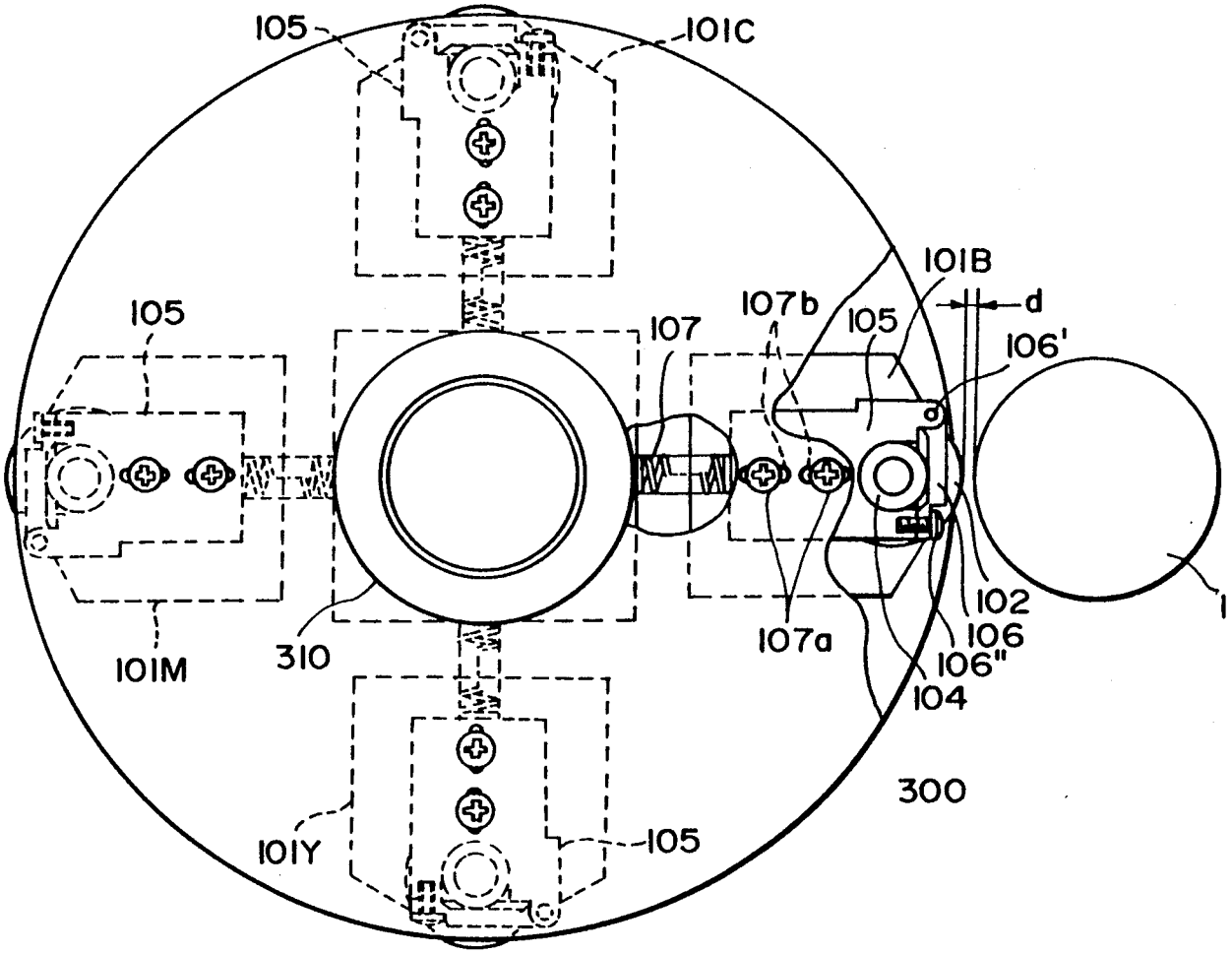
FIG. 5 is a partly broken-away side view of the developing apparatus.

Referring to FIGS. 4 and 5, the description will be made further as to the rotary type developing device 100 used in the image forming apparatus. In FIG. 4, only one, that is, black developing unit 101B among the four units is shown, but the other developing units are supported on the rotary frame 300 in the same way. The mechanical structures of the developing units are the same, and the only difference is in the color of the developer contained therein.

Each of the developing units includes a container 101 for accommodating the developer. The container 101 rotatably supports through a bearing 103 the developing roller, that is, a cylindrical nonmagnetic sleeve 102. In the sleeve 102, a stationary magnet which will be described hereinafter is disposed.

At the opposite ends of a shaft 102' of the developing roller 102, bearings 104 (cylindrical members) are rotatably mounted to the shaft 102'. In this specification, the bearings 104 are part of the shaft of the roller 102. Supporting members (positioning members) 105 for supporting the bearings 104 are fixed on the rotary frame 300 for positional adjustment. The supporting member 105 is provided with a cut-away portion at one side so as to permit mounting and dismounting of the developing unit at a position other than the operating position, and supports an arm 106 for engaging and fixing the bearing 104 to the supporting member 105.

The arm 106 (FIG. 5) is rotatable about a shaft 106' for mounting it to the supporting member 105 so as to permit mounting and dismounting of the developing device 101. By pushing the bearing 104 to the supporting member 105 the developing roller 102 and the developer container 101 can be placed at a predetermined position relative to the photosensitive drum 1.

In order to permit adjustment of the distance d between the photosensitive drum 1 and the developing roller 102 in FIG. 4 when the image forming operation is not performed, for example, when the developing device is assembled, the position of the supporting member 105 fixedly mounted to the rotary frame 300 is changeable to change the distance d.

Figure 6:
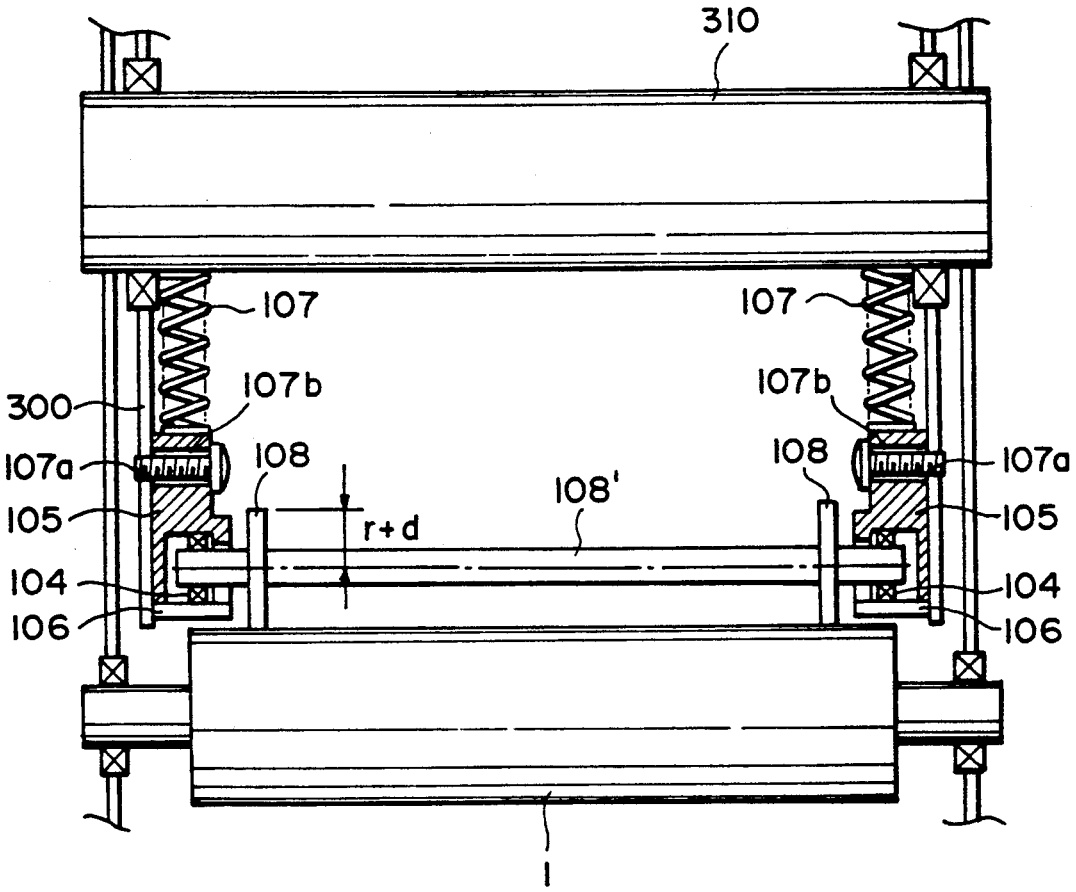
FIG. 6 illustrates position adjustment of the developing apparatus.

Particularly, an urging spring 107 urges the supporting member 105 in a radial direction of the rotary frame 300. As shown in FIG. 6, a tool 108' has a cylindrical member 108 having a radius equal to a sum of a radius r of the developing roller 102 and the distance d (small distance such as not more than 1 mm) between the developing roller 102 and the photosensitive drum 1. The tool 108' is mounted on the supporting member 105 supporting the bearing 104, and thereafter, the tool 108 is press-contacted to the photosensitive drum 1 using the urging force of the spring 107. Then, the supporting member 105 and the rotary supporting member 300 are fixed by screws **107*a*. Subsequently, the tool 108' is dismounted from the supporting member 105. In place thereof, the developing roller 102 having a radius r and associated with the bearing 104 engaged with the shaft 102' is mounted on the supporting member 105 by which the distance between the photosensitive drum 1 and the developing roller 102** is set to be d.

In similar manner, the position of the supporting member 105 of each of the developing units on the rotary frame 300 is adjusted, and each of the supporting members 105 is fixed on the rotary frame 300.

An elongated slot **107*b* is formed to permit movement of the supporting member 105 relative to the rotary frame 300 so as to adjust the distance between the developing roller and the photosensitive drum. A fixing screw 107*a* is inserted through the elongated slot 107*b*. In FIGS. 4 and 6, one elongated slot 107*b* and one screw 107*a* are used for one supporting member 105. However, as shown in FIG. 5, two elongated slots 107*b* and two fixing screws 107*a* may be used for one supporting member 105. A screw 106" securedly fixes to the supporting member 105 the arm 106 for urging the bearing 104 to the supporting member 105**.

In the foregoing embodiment, the developing unit is correctly positioned by engagement between the shaft of the developing roller 102 and the supporting member (positioning member) 105. This method is very preferable in that the gap d between the photosensitive drum 1 and the developing roller 102 can be set with as small as possible mechanical error. However, it is possible that a projection or the like is formed on the container 101, and the projection is engaged to a supporting member position-adjustably fixed on the rotary frame 300, thus positioning the unit.

A common frame 50 functions to support the drum 1 and the shaft 310 for the rotary frame 300.

In the foregoing embodiment, an electrophotographic apparatus is taken in which the plural developing units are rotated to form a multicolor image. However, the present invention is applicable to a multi-color image forming apparatus wherein plural developing devices are movable parallel, as shown in FIG. 7.

Figure 7:
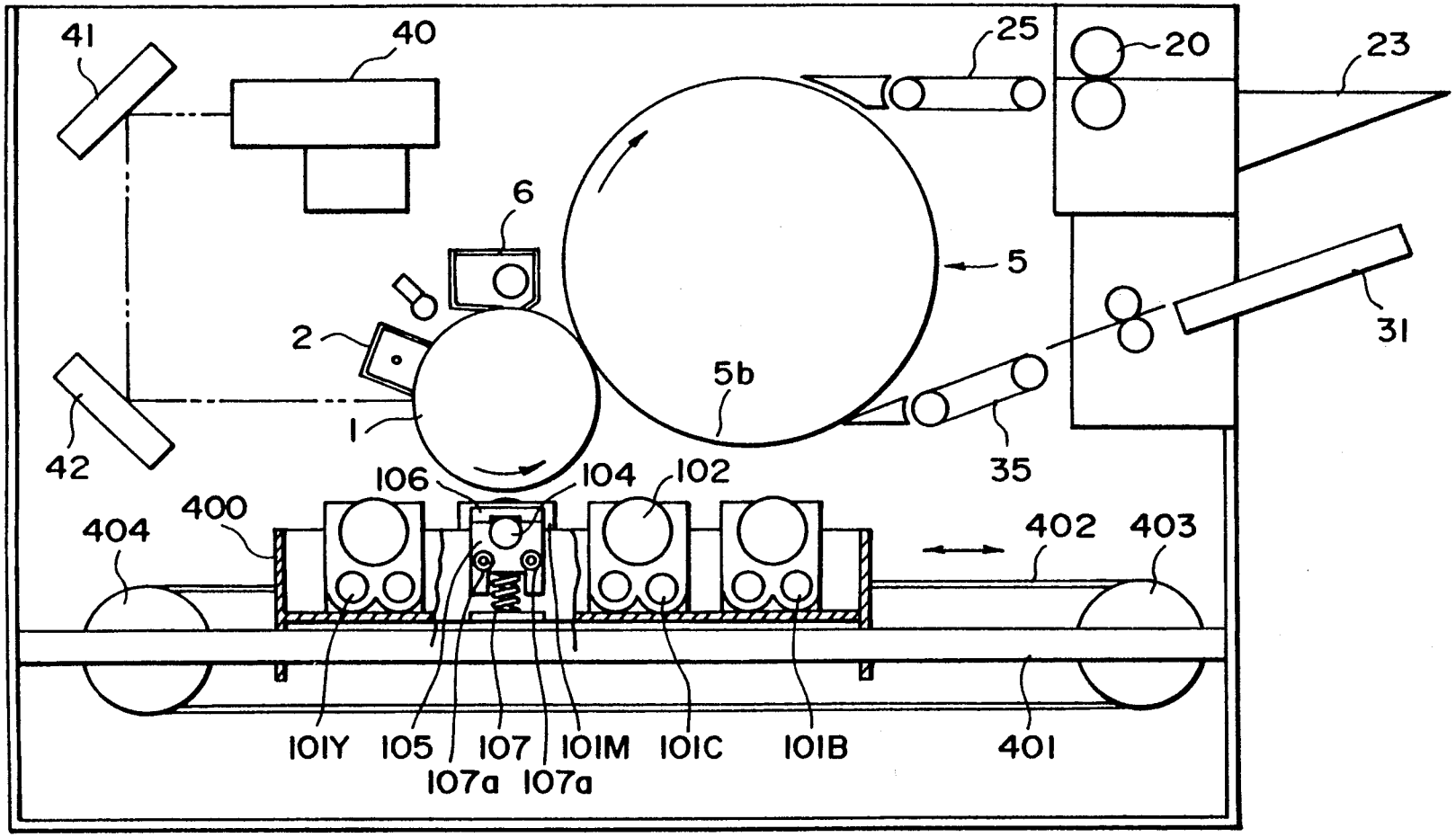
FIG. 7 illustrates a further example of the image forming apparatus to which the present invention is applicable.

In the embodiment of FIG. 7, similarly to the foregoing embodiments, the apparatus comprises a photosensitive drum 1, developing units 101Y–101B for development in the respective colors, a developing roller supported in each of the developing units, bearings 104 supported at opposite ends of each of the developing rollers 102, a supporting member (positioning member) 105 engaged with and supporting the bearing 104, a fixing arm 106 for fixing the developing unit 101 and an urging spring 107 to be used when the position of the supporting member 105 is adjusted.

In this embodiment, similarly to the foregoing embodiment, a tool 108' is used to adjust the position of the supporting member 105. Thereafter, it is fixed on a supporting table 400 by screws 107*a*. Subsequently, the developing unit having the developing roller 102 having the radius r is supported by the supporting member 105 and the arm 106, by which a desired distance d can be provided between the photosensitive drum 1 and the developing roller 102 with the advantages of the foregoing embodiment.

Figure 8:
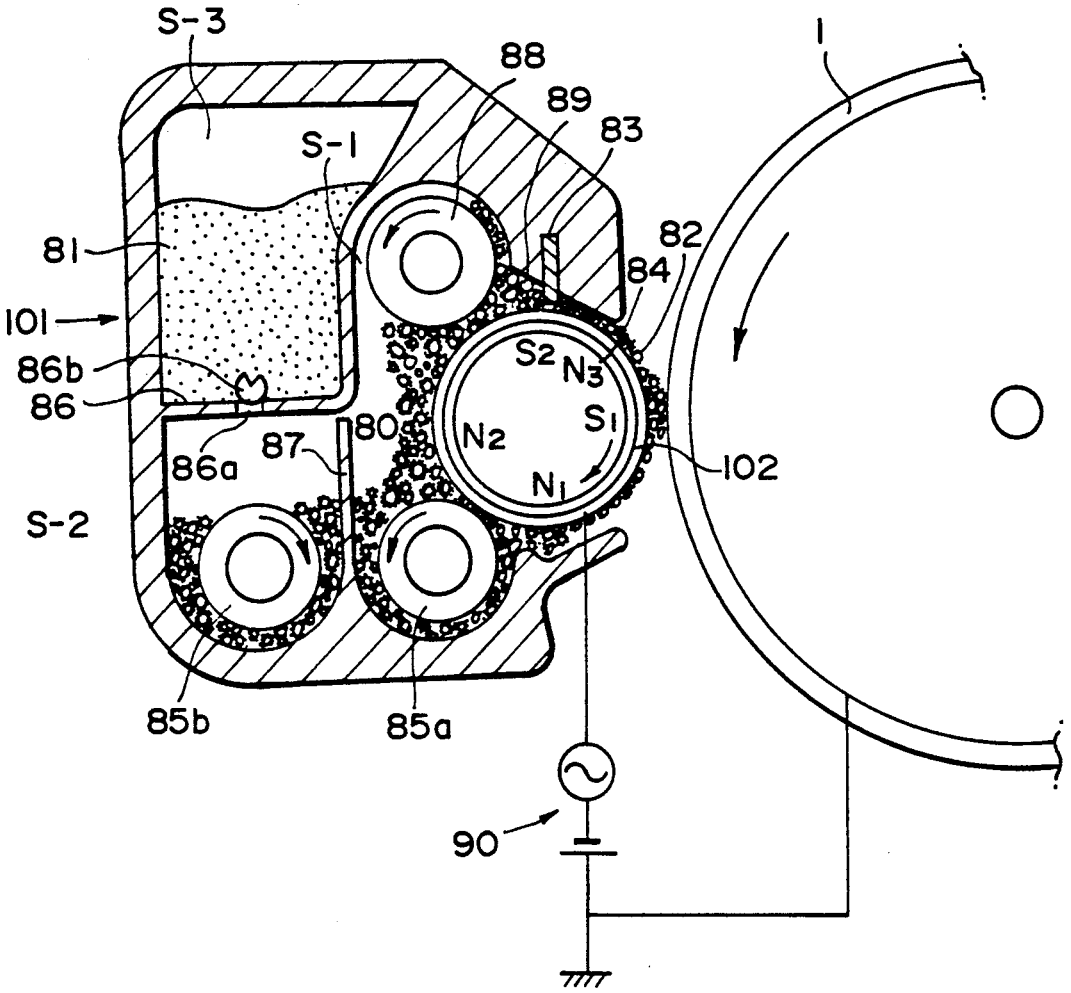
FIG. 8 illustrates an example of a developing unit.

The supporting table 400 carrying the four developing units in FIG. 8 is rectilinearly reciprocable in a horizontal plane along guide rails 401, by which a selected developing unit can be presented to the developing position. A driving wire 402 for the supporting table 400 is trained around pulleys 403, 404 and 402. One of the pulleys receives driving force from a motor for forward rotation.

An optical unit 40 functions to generate a laser beam modulated in accordance with image information and to scanningly deflect the laser beam. Fixed mirrors 41 and 42 are effective to reflect the laser beam to direct it to the drum 1. In the apparatus of FIG. 7, the reverse development is used.

Referring to FIG. 8, the structure of each of the developing units will be described. Each of the developing units includes a developer container 101 for accommodating the developer 80, a developing sleeve 102 functioning as a developer carrying member and a blade 83 functioning to regulate the layer of the developer.

The developer container 101 is provided with an opening at a position adjacent to the photosensitive drum 1. In the opening, the developing sleeve 102 is rotatably supported. Above the developing sleeve 102, the blade 83 is disposed with a predetermined clearance. The developing sleeve 102 is made of nonmagnetic material and rotates in the direction indicated by an arrow in FIG. 8 during the developing operation. A magnet 84 functioning as a magnetic field generating means is fixed within the sleeve 102. The magnet 84 has a developing magnetic pole S1 effective to form a magnetic brush of the developer at the developing position where the developer 80 is supplied to the photosensitive drum 1, and magnetic poles N1, N2, S2 and N3 for conveying the developer.

The blade 83 is made of non-magnetic material such as aluminum (Al), and it is mounted so as to provide a predetermined gap with the surface of the developing sleeve 102. The gap is effective to control or regulate the amount of the developer 80 carried on the developing sleeve 102 to the developing position, more particularly, the thickness of the layer of the developer 80 on the developing sleeve 102. Since the developer is a two component developer containing nonmagnetic toner particles 81 and magnetic particles (carrier particles) 82 mixed therewith in this embodiment, both of the nonmagnetic toner and the magnetic particles are passed through the gap between the free edge of the blade 83 and the developing sleeve 102. The amount of the developer 80 supplied to the blade 89 is regulated by a guiding surface 83.

The non-magnetic toner particles 81 preferably have a particle size not more than 12 microns, preferably not more than 10 microns and not less than 5 microns on the volume average. In this embodiment, the volume average particle size was approximately 8 microns.

The magnetic particles 82 preferably have the particle size of 20–65 microns on the weight average when the particle size of the toner particles 81 is as described above. In this embodiment, the weight average particle size thereof was approximately 50 microns.

In FIG. 8, the conveying magnetic pole N1 and the conveying magnetic pole N2 immediately downstream thereof have the same magnetic polarity, so that a repelling magnetic field is produced therebetween. Therefore, the developer conveyed to the conveying magnetic pole N1 on the sleeve 102 is removed from the sleeve 102 by the repelling magnetic field, and is stirred and mixed by the first screw 85*a*. Adjacent the magnetic pole N2, new developer is supplied.

The developer layer on the sleeve 102 involving the hysteresis of development is removed from the sleeve 102, and the sufficiently mixed new developer is always supplied onto the sleeve 102, and therefore, stabilized images can be provided.

As shown in FIG. 8, the inside of the developer container 101 is divided by a partition wall 87 extending perpendicularly to the sheet of the drawing into a developing chamber (first chamber) S-1 and a stirring chamber (second chamber) S-2. Above the stirring chamber S-2, a toner containing chamber S-3 is defined with a partition wall 86. In the toner container S-3, the toner (non-magnetic toner) 81 for supply is contained. The partition wall 86 is provided with an opening 86*a*, through which an amount, corresponding to the consumption of the toner, of the toner 81 is supplied into the stirring chamber S-2 by a roller 86*b* which has a cut-away portion and which is controlled in its rotation. In the developer chamber S-1 and the stirring chamber S-2, the developer 80 is accommodated. At the front and rear side edges of the developer container 101 in FIG. 8, the partition wall 87 is not formed, but opening (not shown) is formed to communicate the developing chamber S-1 and the stirring chamber S-2.

In the developing chamber S-1, there are a first screw 85*a* which is disposed adjacent the bottom of the developer container 101 and adjacent the developing sleeve 102 and which is rotatable in the direction indicated by an arrow (counterclockwise direction) to feed the developer 8 from the rear side to the front side in FIG. 8, and a second screw 88 which is disposed above the first conveying means 85*a* and which is rotatable in the direction indicated by an arrow (counterclockwise direction) to feed the developer from the front side to the rear side in FIG. 8.

In the stirring chamber S-2, there is a third screw 85*b* which is disposed substantially at the same level as the first screw 85*a* and which is rotatable in the direction indicated by an arrow (clockwise direction) to stir and feed the developer 80 from the front side to the rear side in FIG. 8.

The developing sleeve 102 is supplied with an alternating bias voltage from the voltage source 90. By the application of the AC bias voltage to the sleeve, an alternating field is formed in the developing position. The alternating bias voltage is preferably the one superposed with a DC voltage having a voltage level between the light portion potential and the dark portion potential of the latent image. The waveform may be rectangular, triangular or sine waveform. The alternating voltage is not necessarily the one in which the polarity alternating changes between the positive and negative polarities, but it may be an alternating voltage which vibrates within one of the polarities.

Figure 9:
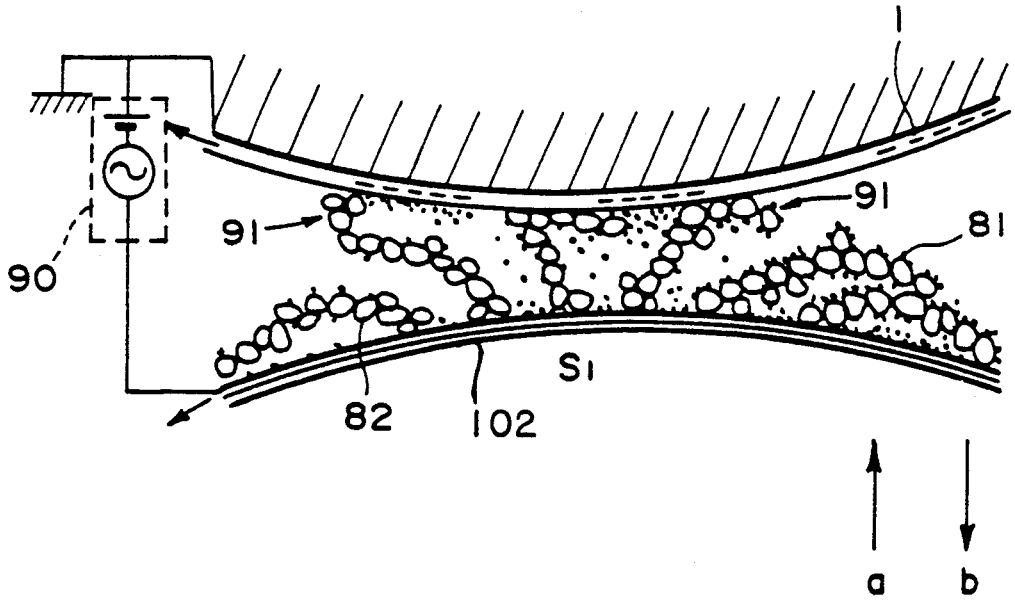
FIG. 9 illustrates the portion where the developing action occurs.

FIG. 9 is an enlarged section view illustrating behavior in the developing position. The photosensitive drum 1 carries electric charge constituting the latent image. In this embodiment, the light portion potential (image portion potential) and the dark portion potential (background portion potential) of the electrostatic latent image are both negative, and the toner is charged to the negative polarity. In this embodiment, the photosensitive drum 1 and the sleeve 102 are rotated in the direction indicated by the respective arrows to provide the peripheral movement in the same direction. Between them, an alternating voltage is applied from the voltage source 90 to form an alternating or vibrating electric field.

In the space between them, a thin layer of the developer which is a mixture of the magnetic carrier particles 82 and the toner particles 81 carried on the sleeve 102 is present on the sleeve. The thin layer of the developer is in contact with the photosensitive drum 1. However, because of the relative volumetric ratio which will be described hereinafter, of the magnetic carrier particles in the space, the amount of the magnetic carrier particles present is far smaller than in the conventional magnetic brush development, and in this respect, the developing method in this embodiment is essentially different from the conventional magnetic brush development. The small amount of magnetic carrier particles 82 are formed into chains 91 in a relatively sparse condition by the function of the magnetic pole S1.

The behavior of the magnetic carrier particles 82 in the developing position is peculiar since the mobility freedom thereof is increased.

More particularly, the sparse chains of the magnetic carrier particles provided uniform distribution, and also release both of the sleeve surface and the surfaces of the magnetic carrier particles, so that the toner particles on the magnetic carrier particle surfaces can be supplied to the photosensitive drum without obstruction by the chains, and because of the uniform exposed surface of the sleeve, the toner particles on the sleeve surface can be transferred onto the surface of the photosensitive drum under the application of the alternating electric field.

The description will be made as to the behavior of the magnetic carrier particles and the transfer of the toner particles.

As shown in FIG. 9 by arrows a and b, the direction of the electric field by the alternating electric field changes alternately. In the phase in which the negative component of the voltage is applied to the sleeve 102, the direction of the electric field is as shown by the arrow b. At this time, the chains 91 are most erected, and the long chains are extended to the surface of the photosensitive drum 1.

Since the toner particles 81 on the sleeve 102 and on the surfaces of the magnetic carrier particles 82 are charged to the negative polarity, they transfer to the photosensitive drum by the electric field formed in the space at this time. Since the chains 91 are erected in the sparse condition, the surface of the sleeve 102 is exposed, so that the toner particles 81 are released from the surface of the sleeve 102 and the surfaces of the chains 91. In the phase wherein the positive component of the alternating voltage is applied to the sleeve 102, the electric field by the alternating voltage is opposite to that shown by the arrow a. Therefore, the chains 91 in the space contract while they are contacted to the photosensitive drum 1.

Since the toner particles 81 on the photosensitive drum 1 are charged to the negative polarity, as described hereinbefore, the electric field at this time is effective to transfer the toner particles back to the sleeve 102 or to the magnetic carrier particles 82. In this manner, the toner 81 reciprocates between the photosensitive drum 1 and the sleeve 102 surface and between the photosensitive drum 1 and the surfaces of the magnetic carrier particles 82. With the expansion of the space by the rotation of the photosensitive drum 1 and the sleeve 102, the electric field becomes weaker, and finally the developing operation is completed.

The foregoing description has been made as to the case of the reverse development. As to the case of the regular development wherein the toner is deposited to the dark potential region, reference is made EP02192-33A.

The description will be made as to the relative volumetric ratio Q (%) for determining the amount of the magnetic carrier particles in the developing position. The relative volumetric ratio is defined in the developing position, that is, the position where the toner is transferred or supplied from the sleeve 102 to the photosensitive drum 1. The relative volumetric ratio Q is defined.

$$Q=(M/h)\times(1/\sigma)\times[C/(T+C)]\times\sigma$$

where M (g/cm$^2$) is an amount of the developer per unit area of the sleeve 102 surface in the developing position when the developer is not erected; h (cm) of the gap in the developing position; $\rho$(g/cm$^3$) is a true density of the carrier particles; C/T+C) (%) is a content, by weight, of the carrier particles on the sleeve surface (C is weight of the carrier particles, and T is weight of the toner particles); $\sigma$ is a peripheral speed ratio between the sleeve 102 and the photosensitive member 1.

The relative volumetric ratio Q changes depending on the structure of the developing unit, particularly the disposition of the magnetic poles of the magnet 84, the strengths of the magnetic poles, configuration of the guiding surface 89 for the developer, the distance d between the edge of the nonmagnetic blade 83 and the surface of the sleeve 102, and the material of the developer.

In the present invention, the clearance between the sleeve and the photosensitive drum is maintained without contact of the spacer to the photosensitive drum. Therefore, if the eccentricity exist in the sleeve and/or the photosensitive drum, the height h of the developing position space in the above equation changes together with the rotations of the sleeve and the photosensitive drum with the result of the change of the relative volumetric ratio.

In the multi-color developing device of the rotary or rectilinearly movable type, the developing device is externally vibrated with the possibility of the change of the relative volumetric ratio.

The changes of the relative volumetric ratio significantly influences the resultant image, particularly, the image density. It is, therefore, desirable that the structure is such that the copy image is not influenced by the small change of the relative volumetric ratio.

The inventors have made various experiments and investigations as to the relationship between the relative volumetric ratio Q and the image density, and have found that good color copy images can be produced if the relative volumetric ratio Q (%) is not less than 25% and not more than 40%.

Figure 10:
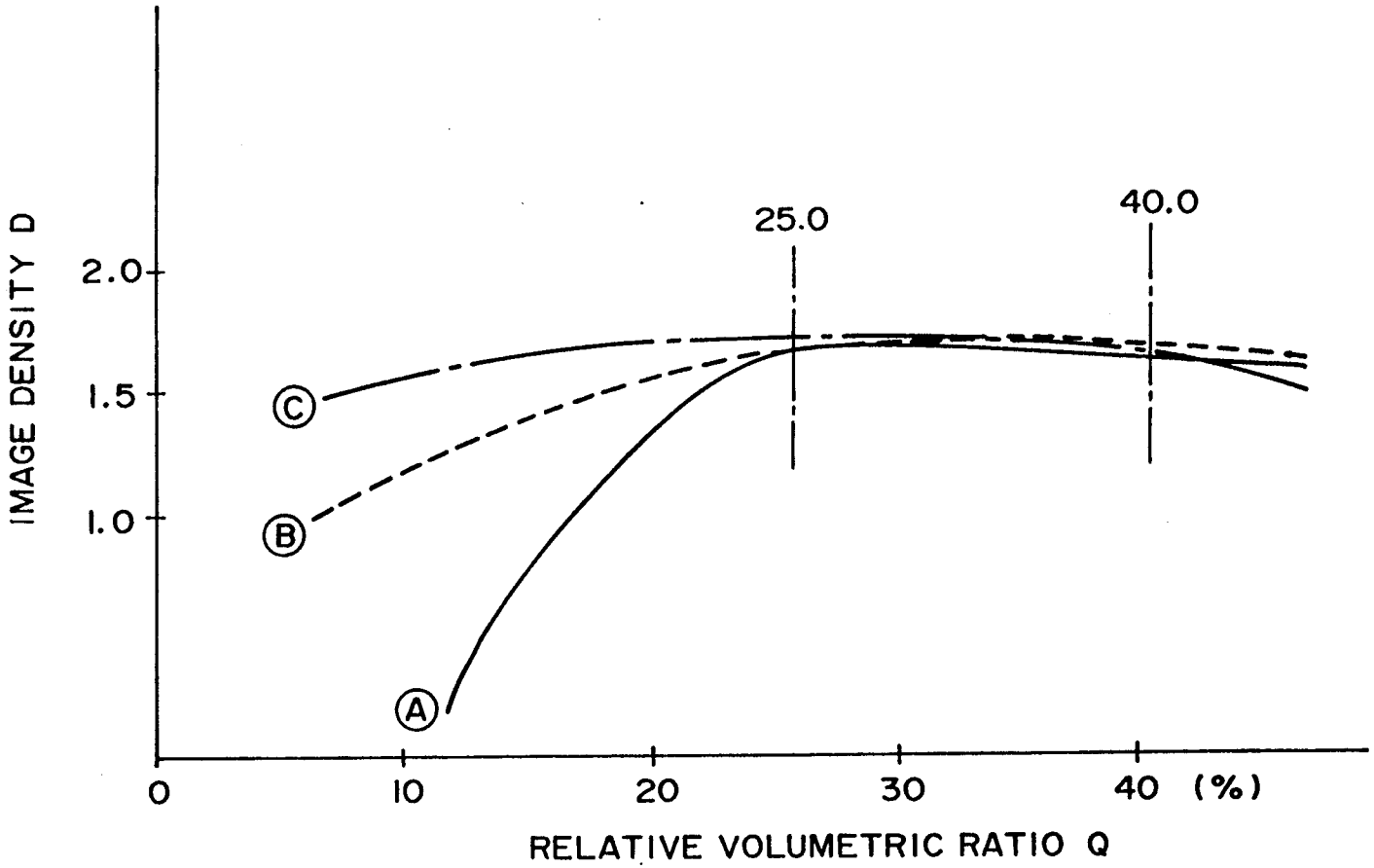
FIG. 10 shows a relationship between a relative volumetric ratio and the image density.

FIG. 10 shows a result of a part of the experiments. The experimental conditions are:

Peripheral speed of the sleeve 102: 280 mm/sec

Peripheral speed of the photosensitive drum 1: 160 mm/sec.

Sleeve 102: stainless steel (SUS) having a diameter of 32 mm.

Magnet: magnetized alternately in the polarity.

Magnetic flux densities on the sleeve surface: S1 pole=1000 Gausses, N1 pole=650 Gausses, N2 pole=500 Gausses, S2 pole=750 Gausses, and N3 pole=500 Gausses.

The clearance between the sleeve 102 and the edge of the blade 83: 800 microns Magnetic carrier particles: volume average particle size of 50 microns, true density of 5 g/cm$^3$, and maximum magnetization of 60 emu/g.

Non-magnetic toner: polyester resin toner having a volume average particle size of 8 microns.

The developing device is incorporated in the color image forming apparatus shown in FIG. 3, wherein the distance d between the photosensitive drum 1 (organic photoconductor) and the surface of the sleeve 102 is 500 microns. The peripheral speed ratio between the photosensitive drum 1 and the developing sleeve 102 is 1:1.75, that is, $\sigma=1.75$. The amount M (g/cm$^2$) of the developer application on the sleeve 102 is 40 mg/cm$^2$. The outer diameter of the photosensitive drum 1 was 80 mm. The photosensitive drum was an OPC drum wherein the dark portion potential was −650 V, and the light portion potential was −200 V. The bias voltage source supplied a rectangular AC voltage having a frequency of 2000 Hz and a peak-to-peak voltage of 2000 V superposed with a DC voltage of −500 V. The investigations have been made as to how the relation changes when the ambient conditions change, the results are also shown in FIG. 10.

In FIG. 10, (A) represents the relation under the condition of 20° C. (temperature) and 10% (humidity); (B) represents the relation under the condition of 23° C. (temperature) and 60% (humidity); and (C) represents the relation under the condition of 30° C. and 80%. As will be understood from the curves, where the relative volumetric ratio is beyond approximately 20%, the image density is not less than 1.5, so that sufficient solid black image can be provided. Where the relative volumetric ratio is not less than approximately 25%, the image density change is small relative to the variation in the relative volumetric ratio, so that the image density is saturated.

From this Figure, it is understood that even if the ambient conditions change, the good images can be provided always, that is, the image density change is extremely small, by satisfying $25 \leqq$ the relative volumetric ratio Q (%) $\leqq 40$.

Where the relative volumetric ratio is smaller than 25%, the image density significantly changes with a slight change of the relative volumetric ratio. Particularly, the change is greater under the low humidity condition. In addition, the thickness of the developer layer formed on the sleeve 102 surface becomes non-uniform with the result of non-uniform image, particularly in the half tone portion of the image. If the relative volumetric ratio exceeds 40%, the degree of closing the sleeve surface by the chains of the magnetic carrier particles increases with the result of production of the foggy background or that the image density decreases by the obstruction to the motion of the developer between the sleeve 102 and the photosensitive member 1.

If the relative volumetric ratio is 20–40%, the chains are desirably sparsely formed on the sleeve 102 surface, so that the toner particles on the surface of the sleeve 102 and the surfaces of the carrier particles are both sufficiently opened to the photosensitive drum 1, by which the toner particles on the sleeve are also transferred to the photosensitive member by the alternating electric field. Accordingly, almost all of the toner particles can be consumed for the development, and therefore, the development efficiency (the ratio of the toner particles consumable for the development to the toner particles existing in the developing position) is increased, and the image density is increased. In addition, the chains vibrate finely by strongly, by which the toner particles on the magnetic carrier particles and the sleeve 102 are powdered. Thus, trace of brushing or production of ghost image as in the usual magnetic brush development can be prevented. In addition, by the vibration of the chains, the frictional contact between the magnetic carrier particles and toner particles is made active, so that the triboelectric charge to the toner is increased, whereby the foggy background can be prevented.

Figure 11:
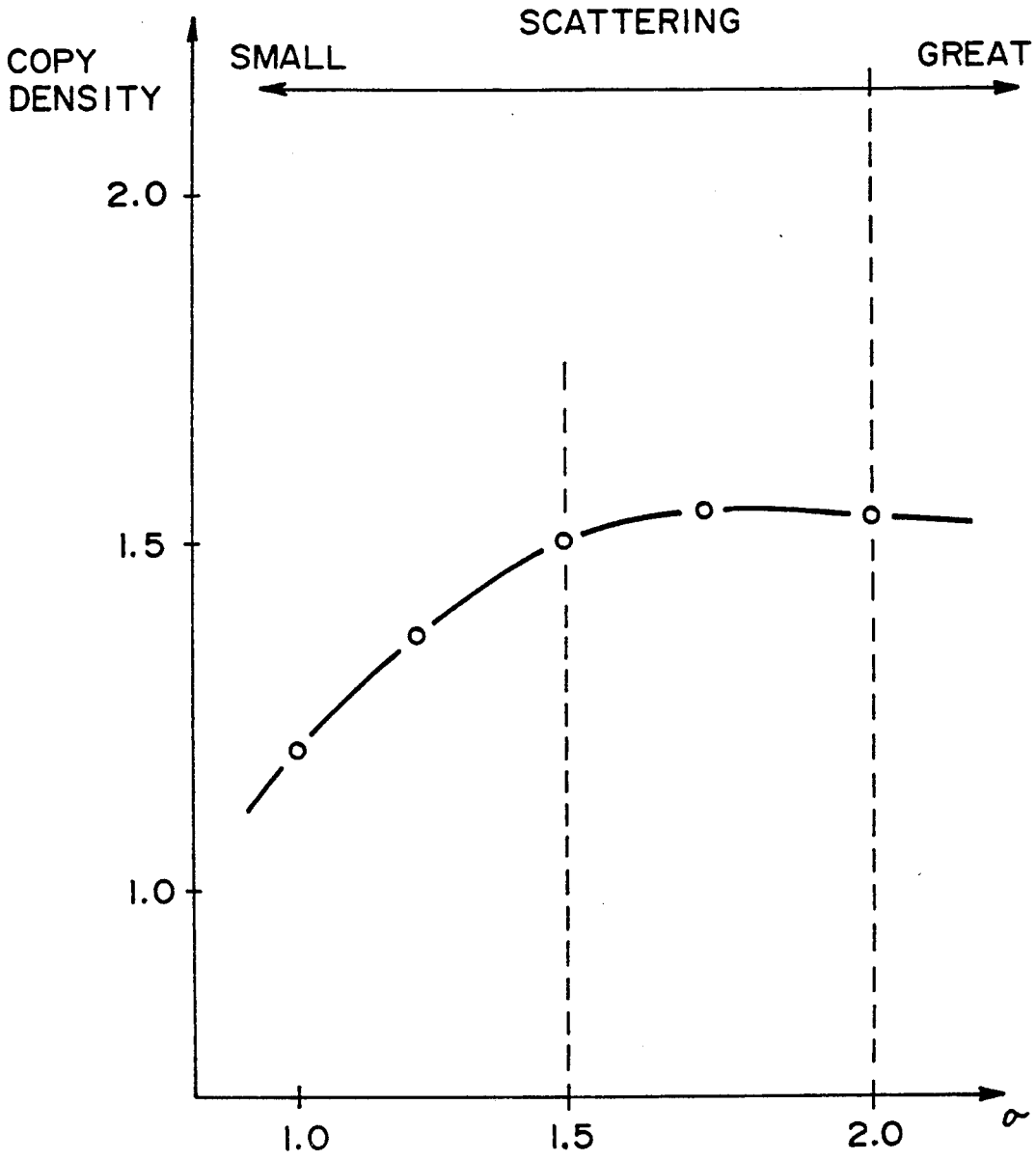
FIG. 11 shows a relationship between a speed ratio and the image density.

As shown in FIG. 11, it is further preferable that the speed ratio $\sigma$ satisfies $1.5 \leqq \sigma \leqq 2.0$. By imparting the relative movement between the sleeve 102 and the photosensitive drum 1, the drum is mechanically rubbed by the developer, by which the fog toner or carrier particles unnecessarily deposited on the photosensitive drum 1 can be removed, and in addition, if the speed ratio is not less than 1.5, the development efficiency can be further increased. If, however, the relative volumetric ratio is increased under the condition of $\sigma<2.0$, the removing effect is too strong with the result that the trace of the brushing or the reduction of the image density occur. If $\sigma \leqq 2.0$, the toner is prevented from scattering outside the developing unit. If $\sigma<2.0$, the image density in a solid black image is not uniform, as in the case where the powder is swept together.

Figure 12:
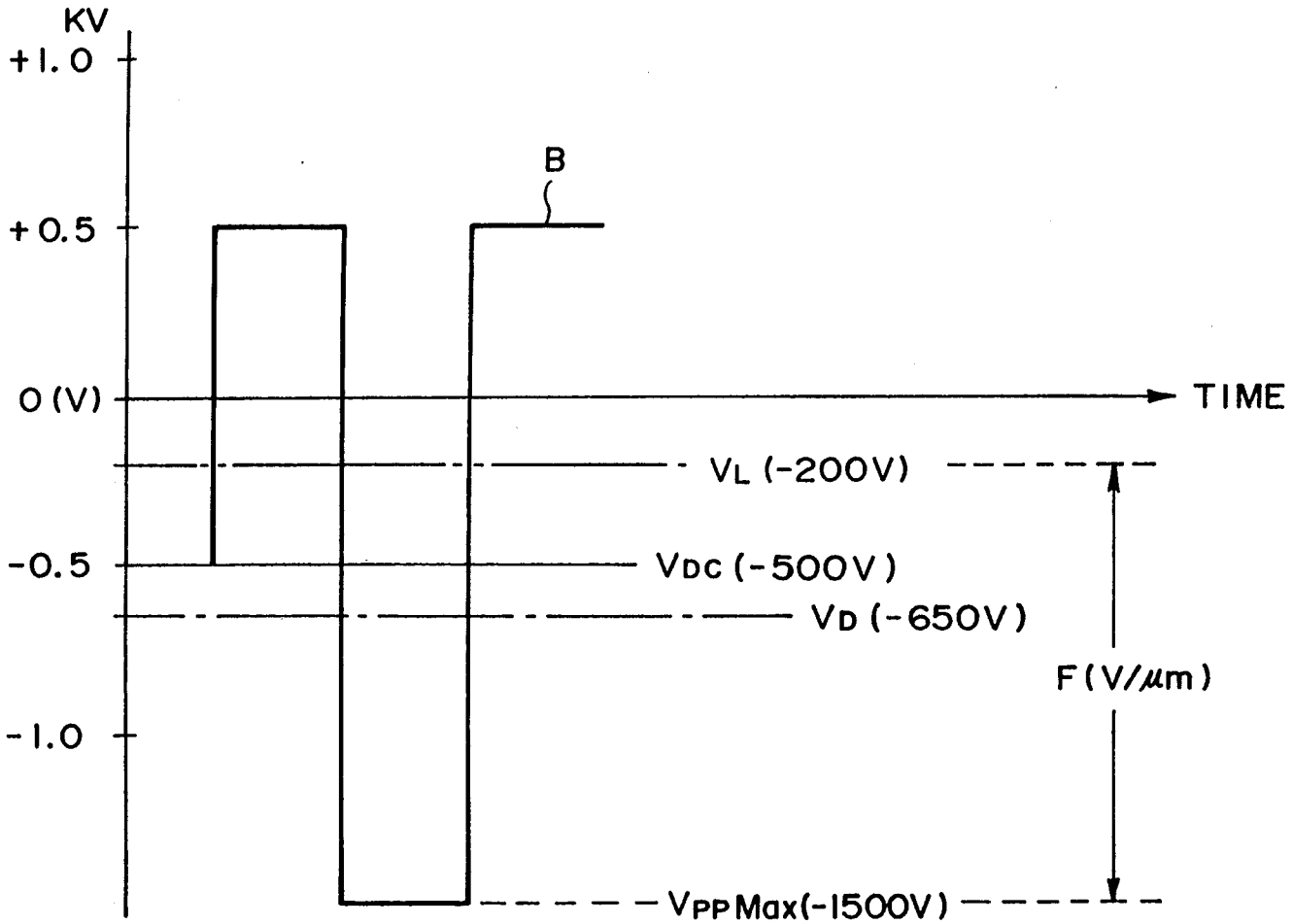
FIG. 12 shows a bias voltage.

Referring to FIG. 12, the description will be made as to the preferable range of the strength of the electric field in the developing position. In FIG. 12, the developing bias voltage applied to the speed is shown as in the form of a rectangular wave, and the developing operation is a reverse development.

In order to prevent the carrier particles from being deposited on the image portion and disturbing the developed image, it is preferable to prevent the deposition of the carrier particles onto the drum in the image area. More particularly, it has been found that if the carrier particles are deposited on the image area, the image density is locally decreased by the carrier particles. The cause of the carrier deposition on the image area involves the problem peculiar to the mixed developer, that is, the maximum strength of the magnetic field to transfer many toner particles to the image area increases the carrier deposition. If, however, the maximum electric field in strength is lowered too much in an attempt to prevent the carrier deposition, the tone reproducibility is deteriorated with the result of insufficient image density.

The maximum electric field strength F (V/micron) in the image portion is expressed.

$$F=[|V_{ppMax}-V_{DC}|+|V_{DC}-V_L|]/d$$

where $V_L$ (V) is a potential at the image portion of the electrostatic latent image; $V_{DC}$ (V) is a DC component voltage of the bias voltage; VppMax (V) is a peak voltage of the bias voltage at a maximum electric field position opposite from the potential $V_L$ of the image portion of the image portion of the latent image relative to the DC component $V_{DC}$; and d (micron) is a minimum distance between the surface of the image bearing member and the surface of the developer carrying member.

In FIG. 12, a latent image having a background potential $V_D$ of −650 V and the image portion potential $V_L$ of −200 V is reverse-developed. In order to prevent the toner particle deposition on the background area, the bias DC component $V_{DC}$ is set −500 V. The sleeve is supplied with such an alternating bias voltage as to provide −1500 V of VppMax, and the minimum clearance d between the sleeve and the drum was changed from 450–600 microns under the condition that above is satisfied, the maximum electric field intensity in the image portion F was 2.89 (V/micron) when d is 450 microns; 2.60 (V/micron) when d is 500 microns; and 2.36 (V/micron) when d is 550 microns; and 2.17 (V/micron) when d is 600 microns. In any of the above cases, hardly any carrier particles were deposited to the image portion, and the tone reproducibility of the toner image was in good order. When the clearance d was changed to 400 microns, the carrier particles were uniformly deposited on the image portion, with the result that the tone reproducibility was deteriorated, and the image was roughened and disturbed, so that the transferred image was nonuniform. The electric field intensity F at this time was 3.25 (V/micron). When the clearance d was 450 microns, the electric field intensity F was 2.89 (V/micron), and only a small amount of carrier particles were deposited on a small part of the image portion, so that the carrier particle deposition was much improved, and the image density was uniform. When the clearance d was increased to 650 microns, the electric field intensity F was 2.00, and the tone reproducibility was deteriorated as compared with the case where the carrier deposition occurs, although the carrier deposition in the image portion was decreased. The sharpness of the line image was also decreased with the reduction of the image density. When the clearance was 600 microns, the tone reproducibility was improved with the sufficient image density.

The experiments were further carried out wherein the alternating electric field itself was changed with the clearance d maintained constant. It has been confirmed that when the maximum electric field intensity F in the image portion is not less than 2.17 and not more than 2.89, the tone reproducibility of the toner image is higher than in the other developing conditions, and hardly any carrier particles are deposited on the image area.

When the electric field intensity F is made not higher than 2.7, the image roughness causes by the carrier particles which occurred locally and slightly when the clearance d was 450 microns (F=2.89) was completely removed with no carrier deposition. Accordingly, the carrier deposition to the image portion is significantly prevented, and the sufficient image density and the tone reproducibility can be obtained, where $2.2 \leqq F \leqq 2.9$, and further preferably, $F \leqq 2.8$.

Further preferable conditions are as follows. The carrier particles are preferably middle or high resistance particles rather than insulative particles, more particularly, the volume resistivity thereof is not less than $10^7$ ohm.cm and not more than $10^{12}$ cm, further preferably not less than $10^8$ ohm.cm and not more than $10^{10}$ ohm.cm. In addition, they preferably have thin resin layers. The carrier deposition other than the carrier deposition onto the image portion with result in the background deposition, but the deposition on the background area is also prevented by the present invention. To achieve this, the following is preferably satisfied even if the DC component $V_{DC}$ (V) is variable relative to the background potential $V_D$ (V):

$$50 \leqq |V_{DC}-V_D| \leqq 200.$$

In addition, since the background potential can change depending on the ambient conditions, it is further preferably not more than 150 V in order to enhance the assurance.

Those preferable conditions apply to the regular development system wherein the toner is deposited on the dark potential $V_D$ portion with the light potential $V_L$ portion being background.

What is claimed is:

1. An image forming apparatus, comprising:

an image bearing member;

latent image forming means for forming an electrostatic latent image on said image bearing member; and developing means for developing the latent image, said developing means including;

a plurality of developing units for supplying to said image bearing member developers of different colors, each of said developing units including a container for containing one of the developers and a developer carrying roller for carrying the developer from said container to a developing position, said developer carrying roller having a shaft portion at an end thereof;

supporting means for supporting said plurality of developing units and movable along a predetermined path to present a selected one of said developing units to an operating position for developing the latent image, said supporting means including a movable supporting frame movable along the path, a plurality of positioning members fixed on said movable supporting frame, each of said positioning members having an engaging portion for engaging the shaft portion of the developer carrying roller of a respective developing unit, and adjusting means for adjusting positions where said positioning members are fixed on said supporting frame, wherein the shaft portion of each of said developer carrying rollers is engaged to and positioned by a respective one of said positioning members, whereby each of said developing units is disposed in facing relationship with said image bearing member at the operating position without contact with said image bearing member, and whereby each of said developer carrying rollers is disposed in facing relationship with said image bearing member at the developing position with a predetermined distance therebetween for supplying the developer to the image bearing member to develop the latent image.

2. An apparatus according to claim 1, wherein said supporting means is rotatable.

3. An apparatus according to claim 1, wherein said supporting means is rectilinearly reciprocable.

4. An image forming apparatus, comprising:

an image bearing member;

latent image forming means for forming an electrostatic latent image on said image bearing member;

developing means for developing the latent image, said developing means including:

a plurality of developing units for supplying to said image bearing member developers of different colors, each of said developing units including a container for containing one of the developers containing toner particles and magnetic carrier particles mixed together, a non-magnetic developer carrying sleeve for carrying the developer from the container to a developing position, said sleeve having a shaft portion at an end thereof, and a magnet disposed within said developer carrying sleeve;

supporting means for supporting said plurality of developing units and movable along a predetermined path to present a selected one of said developing units to an operating position for developing the latent image, said supporting means including a movable supporting frame movable along the path, a plurality of positioning members fixed on said movable supporting frame, each of said positioning members having an engaging portion for engaging the shaft portion of the developer carrying roller of a respective developing unit, and adjusting means for adjusting positions where said positioning members are fixed on said supporting frame, wherein the shaft portion of each developer carrying sleeve is engaged to and positioned by a respective one of said positioning members, whereby each of said developing units is disposed in facing relationship with said image bearing member at the operating position without contact with said image bearing member, and whereby each said developer carrying sleeve is disposed in facing relationship with said image bearing member at the developing position with a predetermined distance therebetween for supplying the developer to the image bearing member to develop the latent image; and a voltage source for applying an alternating bias voltage to the developer carrying sleeve of the developing unit placed at the operating position to form an alternating electric field in the developing position;

wherein a relative volumetric ratio Q (%) of the magnetic carrier particles at the developing position satisfy in each of the developing units $$25 \leqq Q \leqq 40.$$

5. An apparatus according to claim 4, wherein said image bearing member comprises an electrophotographic photosensitive member, and said latent image forming means comprises means for projecting a beam modulated in accordance with electrical image signals onto said photosensitive member, and wherein the toner particles of the developer carried to the developing position by said developer carrying sleeve of each of said developing units is charged to a polarity which is the same as the polarity of the latent image, and each of the developing units reverse-develops the latent image.

6. An apparatus according to claim 5, wherein a maximum intensity F (V/micron) of the alternating electric field at an image portion of the latent image satisfies in each of the developing units $$2.2 \leqq F \leqq 2.9.$$

7. An apparatus according to claim 6, wherein peripheral speed ratio $\sigma$ of the developer carrying sleeve to the image bearing member satisfies in each of the developing units $$1.5 \leqq \sigma \leqq 2.0.$$

8. Any apparatus according to any one of claims 4, 6 and 7, wherein said supporting means is rotatable.

9. An apparatus according to any one of claims 4, 5, 6 and 7, wherein said supporting means is rectilinearly reciprocable.

10. An apparatus according to any one of claims 4, 5, 6 and 7, wherein the magnet of each of said developing units is effective to erect chains of magnetic carrier particles toward said image bearing member at the developing position to contact them to said image bearing member, and wherein the electrostatic latent image is developed under the alternating electric field with the toner particles on a surface of the developer carrying member and on surfaces of the magnetic particles.

11. An apparatus according to claim 10, wherein said supporting means is rotatable.

12. An apparatus according to claim 10, wherein said supporting means is rectilinearly reciprocable.

* * * * *

UNITED STATES PATENT AND TRADEMARK OFFICE

CERTIFICATE OF CORRECTION

PATENT NO. 5,294,967

DATED March 15, 1994

INVENTOR(S) MUNAKATA ET AL.

It is certified that error appears in the above-indentified patent and that said Letters Patent is hereby corrected as shown below:

Column 1

Line 12, delete "a".
Line 14, change "an" to --a--.

Column 6

Line 6, change "shaft 106'" to --shaft 106' (Fig. 5)--.

Column 8

Line 9, change "blade 89" to --blade 83--.
Line 10, change "surface 83." to --surface 89.--

Column 10

Line 32, change "made" to --made to--.
Line 41, change "defined." to --defined,--.
Line 49, change "C/T+C)" to --C/(T+C)--.
Line 65, change "exist" to --exists--.

Column 11

Line 29, remove the bold print from "Gausses".
Line 31, change "microns" to --microns.--

UNITED STATES PATENT AND TRADEMARK OFFICE

CERTIFICATE OF CORRECTION

PATENT NO. 5,294,967

DATED March 15, 1994

INVENTOR(S) MUNAKATA ET AL.

It is certified that error appears in the above-indentified patent and that said Letters Patent is hereby corrected as shown below:

Column 13

Line 21, delete "image portion of the".

Column 14

Line 4, change "causes" to --caused--.

Column 16

Line 38, change "Claims 4," to --Claims 4, 5,--.

Signed and Sealed this

Sixth Day of December, 1994

*Attest:*

*Attesting Officer*

Bruce Lehman

BRUCE LEHMAN

*Commissioner of Patents and Trademarks*